United States Patent [19]

Janney

[11] Patent Number: 4,970,125

[45] Date of Patent: Nov. 13, 1990

[54] CANTILEVERED INTEGRAL AIRFOIL CASTING AND METHOD

[75] Inventor: David F. Janney, Coral Gables, Fla.

[73] Assignee: Chromalloy Castings Miami Corp., San Antonio, Tex.

[21] Appl. No.: 6,957

[22] Filed: Jan. 27, 1987

Related U.S. Application Data

[63] Continuation of Ser. No. 718,347, Apr. 1, 1985, abandoned.

[51] Int. Cl.[5] ..... B21K 3/04

[52] U.S. Cl. ..... 428/579

[58] Field of Search ..... 428/577, 579, 582, 583, 428/585, 587; 164/30, 31, 32, 332, 333, 334, DIG. 10; 29/418

[56] References Cited

U.S. PATENT DOCUMENTS

| | | | |
|---|---|---|---|
| 1,128,854 | 2/1915 | Coppus | 164/334 |
| 1,911,040 | 5/1933 | Schultz | 164/334 |
| 2,479,039 | 8/1949 | Cronstedt | 164/333 |
| 2,510,735 | 6/1950 | Bodger | 164/333 |
| 2,639,886 | 5/1953 | Townhill et al. | 164/333 |
| 2,745,353 | 5/1956 | Syrovy | 164/333 |
| 2,841,838 | 7/1958 | Covitt | 164/32 |
| 3,815,660 | 6/1974 | Gallagher et al. | 164/332 |
| 3,819,145 | 6/1974 | Huber et al. | 164/334 |
| 3,859,712 | 1/1975 | Tramposch | 29/418 |
| 4,489,469 | 12/1984 | Hall | 164/112 |

FOREIGN PATENT DOCUMENTS

| | | | |
|---|---|---|---|
| 53-33091 | 10/1978 | Japan | 164/332 |
| 28280 | of 1908 | United Kingdom | 164/333 |

*Primary Examiner*—John J. Zimmerman

*Attorney, Agent, or Firm*—Jack E. Dominik

[57] ABSTRACT

An outer stabilizing band or bands at the unsupported end portion of the air foils changes the configuration from an unsupported cantilevered airfoil to a baband supported airfoil during the forming of the mold and casting of the product. Such band or bands, which are later shaved away, permit dimensional stabilization and provide an outer wall for venting, fill-out, and inclusion trapping. The stabilizing band or bands are extremely thin, normally in the range of 20 to 60 one thousandths of an inch, which avoids the need for gating and minimizes the amount of machining required to remove such stabilizing band or bands from the integral airfoil and hub casting. The bands may be outside the end of the airfoil or flush with the ends of the airfoil. The procedure and method for incorporating the outer band or bands into the casting begins with the process of making the pattern. It also aids in the stabilizing of the configuration of the pattern thereby achieving more dimensional accuracy. This is applicable whether soluble patterns, one piece wax patterns, or patterns made of assembled parts are involved.

8 Claims, 5 Drawing Sheets

FIG. 7
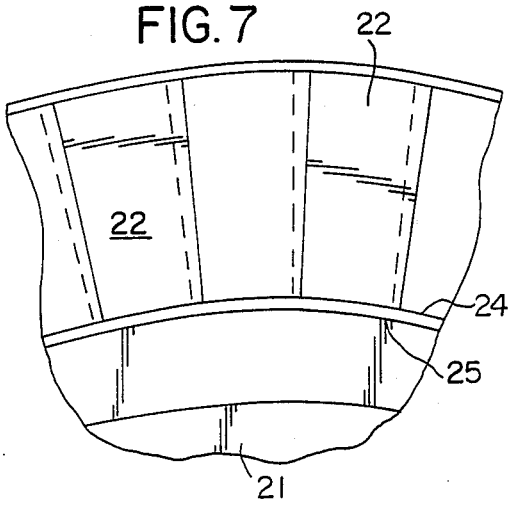
FIG. 9
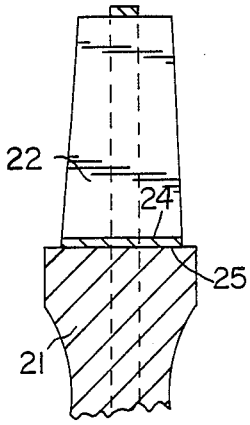
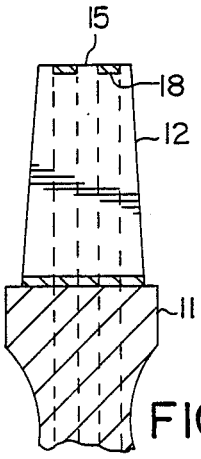
FIG. 10
FIG. 8
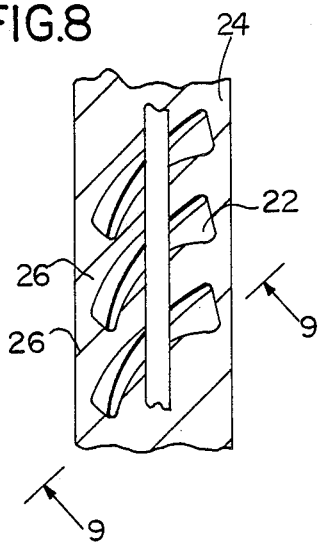
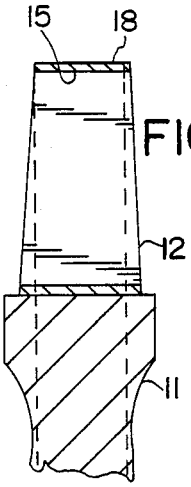
FIG. 11
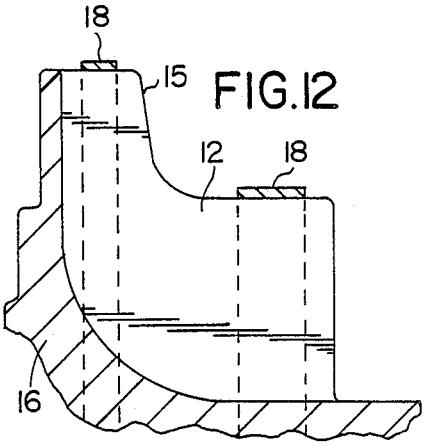
FIG. 12

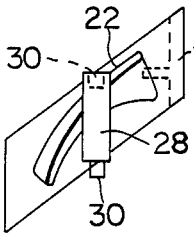
FIG.14
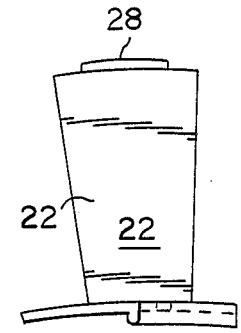
FIG.15
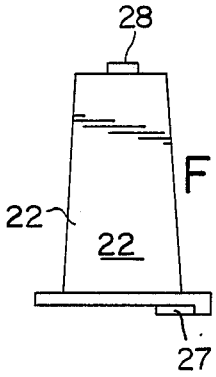
FIG.13
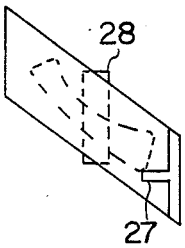
FIG.16
FIG.19
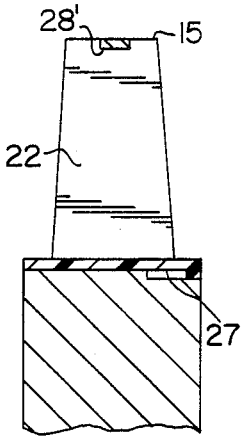
FIG.17
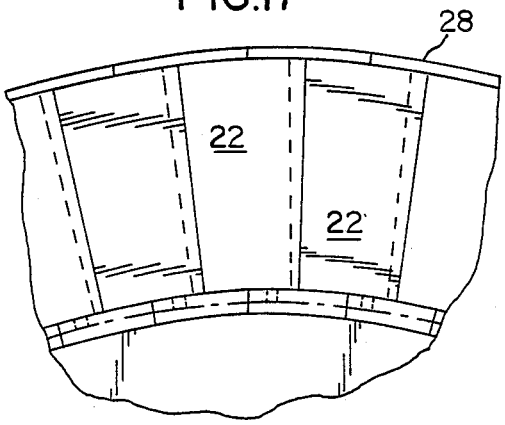
FIG.18
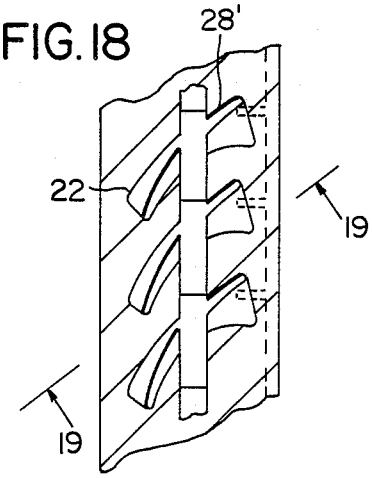

FIG.20
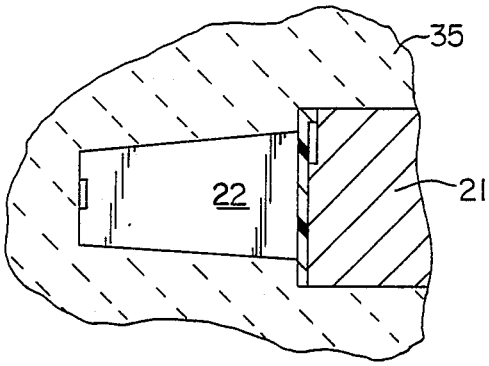
FIG.23
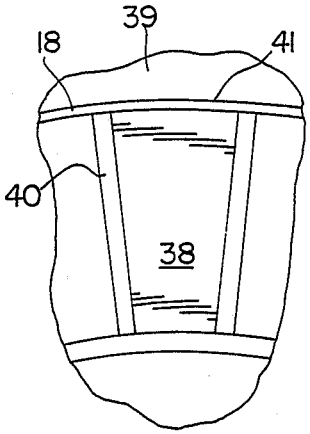
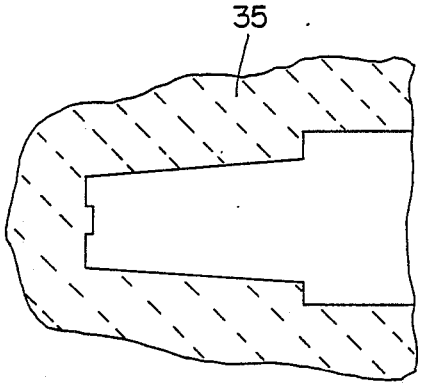
FIG.21
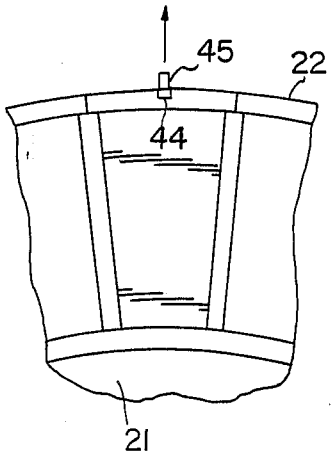
FIG.24
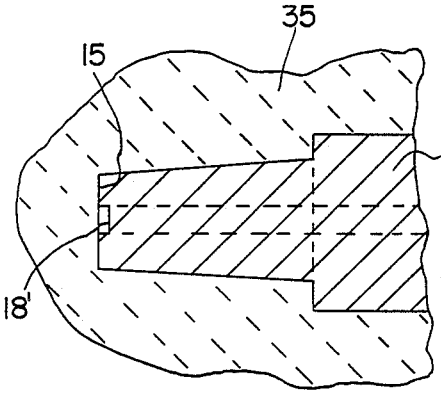
FIG.22

CANTILEVERED INTEGRAL AIRFOIL CASTING AND METHOD

This is a continuation of application Ser. No. 718,347 filed Apr. 1, 1985 now abandoned.

FIELD OF THE INVENTION

The present invention is directed to a casting and method including cantilevered integral air foils with stabilizing bands. The method begins with the preparation of the pattern for the investment casting which is integral, and continues through the various metal treatment steps until the casting is being machined for final usage.

SUMMARY OF THE PRIOR ART

Jet engines, gas turbines, turbochargers, air compressors, and air separators all require airfoil sections some of which rotate, and others of which remain stationary. The rotary members in a jet engine can be in both the cold and the hot sections. The cold section or compressor can be multi-stage, including axial flow and a centrifugal flow. The airfoil sections are referred to as blades or buckets in the rotary configuration, but in the stator or immovable configuration, such as a nozzle, they are referred to as vanes. The present invention contemplates all of the configurations just referred to as well as all of the applications and others where a cantilevered airfoil positioned about a hub may be utilized. The most common configuration is a disc-like hub with exterior cantilevered blades. Such castings may be made of stainless steel, alloy steels, aluminum, or nickel and cobalt based alloys. The present invention is substantially independent of the type of metal used, and can be employed with virtually every metal used to make cantilevered airfoil/hub-type products.

In some applications the airfoil is joined at one end to the hub, and has a shroud at the outside. In the course of casting, the dimensional stability of the shrouded airfoil is enhanced by the structural strength of the shroud itself. In the cantilevered configuration, the airfoil can twist, bow be radially displaced, or be fore and aft displaced, all of which compound the dimensional instability from the exact size and configuration of the design.

The cantilevered-type airfoil, when used in a turbine, permits the size of the hub and the airfoil cross-section to be minimized due to the absence of the rotating mass on the outer blade tips of the shroud. This results in lower weight and more satisfactory aerodynamics. Also, cantilevered air foils on non-rotating integral castings result in ease of manufacture and weight savings.

All air foils, whether for turbines, turbochargers or air compressor machinery, are required to be manufactured to close tolerances on the order of ±0.003/0.005 inches for the contour in order to perform aerodynamically. In addition when the individual cantilevered air foils are cast separately, the attachment point must be machined to tolerances in the range of ±0.0001/0.0002 inches so that the air foils can be grouped together onto a turbine wheel hub; with the air foils in a common plane within ±0.010 inches or less so that the assembled wheel will perform aerodynamically and also can be rotated at high speeds in the range of 1,000 to 60,000 revolutions per minute without having out-of-balance problems brought on by the lack of coplanarism of the air foils, particularly at the blade tips where the air foils are unsupported.

This out-of-balance condition leads to vibration and harmonic problems, which may cause the failure of the rotating assembly or even failure of the shaft bearings supporting the airfoil assembly. In addition to the concern for coplanerism of the airfoil, proper angle of attack (sometimes called the twist) and the displacement (or equal spacing) of the blades are of concern both for reasons of aerodynamic performance and for mass inertia problems related to harmonics and balancing.

All of the above characteristics can be well controlled in the manufacture of cantilevered air foil castings, which are manufactured individually and assembled onto a common hub, with the machining at the attachment points accomplished in such a fashion as to bring about coplanerism of the air foils (especially at the outer tips) equal spacing between the airfoils and the proper angle of attack of the air foils relative to each other and the axis of rotation.

The problems encountered when manufacturing an integral airfoil casting with cantilevered air foils are primarily attributable to the fact that the air foils must be so precisely dimensioned and toleranced. Accordingly, they are attached only at one end, with the opposite unattached end free to move about during the various phases of the manufacturing process.

The investment casting of integral airfoils and hubs involves essentially several distinct phases. The first phase is the making of the disposable pattern and mold. The second phase is the pouring of casting and solidification of the same. The third phase is the removal of the mold materials. Additional phases are the treatment and inspection of the casting, to and including, the point of machining.

Set forth below are some of the problems during the pattern making steps of producing cantilevered airfoil castings.

1. During manufacture of the integral airfoil pattern, when using water soluble wax segments and then injecting a pattern wax between the soluble wax segments to form the desired pattern, the soluble segments shift during injection and the resultant airfoils are thus dislocated and do not meet the dimensional uniformity desired in regards to airfoil countour tolerance bands. This is especially true at the airfoil tips where the air foils are unsupported.

2. During manufacture of the integral airfoil patterns, when using only the pattern wax and straight pull radial tool inserts, the shape as measured by the airfoil tolerance band is usually acceptable, but the equal spacing and coplanerism at the airfoil tips is unacceptable.

3. During manufacture of the integral airfoil pattern, when using individually injected air foils of either wax or plastic, due to the inability of the tool inserts to be withdrawn radially because of undercuts or back tapers created by the twist of the individual air foils, the coplanerism and equal spacing at the airfoil tips is often unacceptable. Great care is usually taken, upon completion of the assembly operation to measure the coplanarism, spacing and angle of attack before the individual airfoil segments are joined into a final pattern (so as to have the opportunity to attempt to adjust the improperly located airfoils for dimensional acceptability), only to lose the desired dimensions when the parts are joined. Additionally, stresses are encountered during the assembling of the airfoil segments which results in dimensional distortion after the assembled pattern is removed from the assembly fixture and its locating elements.

Some of the problems encountered during the molding phases of the process, which comprises forming of the ceramic shell and dewaxing of the mold and casting, include the following:

1. During the molding process, the airfoil tips are unsupported and can lose their coplanerism and equal spacing due to the forces applied to the patterns as the ceramic materials are applied. Moreover, this is combined with the fact that the ceramic shell is still in its green state and has only partial strength at this point in the manufacturing sequence.

2. During the dewaxing or pattern removal portion of the manufacturing cycle, the airfoil tips dislocate due to expansion pressures from the pattern material being removed under in an oven at atmospheric pressures with temperatures as high as 2,200° F. and/or in an autoclave at pressures up to several atmospheres and temperatures up to 500° F.

3. During the mold preheating phase of casting, the airfoil tips are free twist or dislocate or sag due to the expansion of the shell as well as to the almost plastic condition of a fired ceramic.

4. During the casting portion of the manufacturing cycle, the airfoil tips are free to twist or dislocate during the contraction that takes place during solidification. This volumetric and linear contraction is in the range of 2% as measured both volumetrically and linearly and this is the cause of twisting and warping as cooling takes place. The blade tips lose their coplanerism, twist out of location in regard to angle of attack and lose their equal spacing.

Finally, during the post-molding phase, comprised of heat treating, sandblasting, inspection machining, gaging, and the like, the following problems are typically encountered:

1. During the heat treating steps, wherein it is common practice to heat treat turbine components to near their melting point, further distortion and warping of the airfoil tips can take place.

2. Due to the pressure from sandblast cleaning and cosmetic bench grinding of the air foils, distortion, warping, and bending of the airfoil tips can take place.

3. During the inspection and gaging operations, distortion, warping, and bending of the airfoil tips can take place because of the handling required.

4. During shipping of the casting to the machine shop facility, distortion, warping and bending of the airfoil tips can take place due to the handling required.

Additional problems, occuring primarily during casting, which cannot usually be detected until after the product is cast and may result in a quality control rejection, since only one defect in only one of many blades may cause the rejection of the entire casting include the following:

1. During casting of the integral cantilevered airfoils, unwanted metallic and non-metallic inclusions are often trapped in the airfoil tips because they are dead-end appendages.

2. During casting of the integral cantilevered air foils, internal gas is often trapped in the outer airfoil tips due to lack of venting caused by the dead-end appendages.

3. During casting of the integral cantilevered air foils, air is trapped inside the mold at the blade tips causing an internal back pressure which causes no-fill on the very thin leading and trailing edges of the airfoil tips, due to the slower flow of molten metal as the airfoil is filled and the air or gas is trapped inside. It is not practical to vent every airfoil tip as there is often as many as 60 to 70 blades or vanes and seldom less than 10 to 15 per casting.

4. During casting of the integral cantilevered air foils in a vacuum atmosphere of even as low as one micron of an inch of mercury, the filling out of the airfoil tips is retarded by the dead-end configuration of the mold, resulting in surface tension which retards the wetting action of the molten metal.

As a result of having to address all of the foregoing problems, an in-process and/or final inspection and straightening step must be incorporated into the sequence of manufacturing. This is time consuming and considerable additional expense is incurred to correct dimensionally deficient and poorly casted molds. In those cases where no-fill, gas, or inclusions are visually present, the castings are invariably subject to quality control rejection and a significantly higher scrap rate is experienced.

SUMMARY OF THE INVENTION

The invention stems from the discovery that providing an outer stabilizing band or bands at the unsupported end portion of the air foils changes the configuration from an unsupported cantilevered airfoil to a band supported airfoil during the forming of the mold and casting of the product. Such band or bands, which are later machined away, permit dimensional stabilization and provide an outer wall for venting, fill-out, and inclusion trapping. The stabilizing band or bands are extremely thin, normally in the range of 20 to 60 one thousandths of an inch, which avoids the need for gating and minimizes the amount of machining required to remove such stabilizing band or bands from the integral airfoil and hub casting. The reinforcing bond may be flush with the ends of the airfoil or outside the end of the airfoil when cast. The optimum thickness and orientation of the reinforcing band is within the machining zone of the end of the airfoil to thereby permit machining the end of the airfoils and removal of the band in one step. Thus the dimension of the thickness of the band as well as the fillet where it joins the airfoil should be the same or less than the machining stock provided at the end of the airfoil which is intended to be machined away. The procedure and method for incorporating the outer band or bands into the casting begins with the process of making the pattern. It also aids in the stabilizing of the configuration of the pattern thereby achieving more dimensional accuracy. This is applicable whether soluble patterns, one piece wax patterns, or patterns made of assembled parts are involved.

In view of the foregoing it is a principal object of the present invention to provide a casting for a cantilevered integral airfoil and hub which is inherently dimensionally stable and at the same time assists in purging the part of undesirable voids and contaminants.

Yet another object of the present invention is to achieve the dimensional stability of the casting with a construction involving minimal increase in cost while significantly reducing quality control rejection rates and post-casting dimensional adjusting.

A further object of the present invention is to provide for an integral casting having radial airfoil sections which involves modest modification to the existing tooling in the existing investment casting shop where the integral castings of the prior art have been heretofore made.

BRIEF DESCRIPTION OF THE DRAWINGS

Further objects and advantages of the present invention will become apparent as the following description of illustrative embodiments proceeds taken in conjunction with the accompanying drawings, in which:

FIG. 7 shows diagrammatically a broken portion of an assembled pattern configuration for rotor airfoils;

FIG. 8 is an end view of the airfoil sections shown in FIG. 7 and partially broken;

FIG. 9 is a lateral transverse sectional view of the assembled airfoils and supports in the pattern taken along section line 9—9 of FIG. 8;

FIG. 10 is taken along section line 9—9 of FIG. 8 but showing an alternative embodiment in which two stabilizing bands are used, and wherein the reinforcing bands are oriented flush with the end of the airfoil casting;

FIG. 11 is a further alternative taken along section line 9—9 of FIG. 8 showing a single band the entire width of the airfoil sections;

FIG. 12 is an enlarged section portion of the airfoils as shown in FIG. 5, but illustrating a two stabilizing band configuration;

FIG. 13 is a front elevational view of a single airfoil pattern;

FIG. 14 is a top view of an individual airfoil pattern;

FIG. 15 is a side view of a single airfoil pattern;

FIG. 16 is a view taken from underneath a single airfoil pattern;

FIG. 17 shows a plurality of airfoil patterns joined and with their underneath platformed sections and engagement with a hub portion of a mold;

FIG. 18 is an end view taken radially along the top of an assembled airfoil pattern having a plurality of individual airfoil segments, and wherein the reinforcing band is shown in its alternative flush location;

FIG. 19 is a section view taken along section 9 line 19—19 of FIG. 18 except where the reinforcing band is shown in its alternative location;

FIG. 20 is a partially broken diagramatic view showing a pattern interiorly of a ceramic mold wherein the reinforcing band portion is in its flush location;

FIG. 21 is a view sequential to FIG. 20 showing the void within the mold after the pattern has been removed either by firing of or autoclaving or otherwise dissolving the same and wherein the reinforcing band is in its flush location;

FIG. 22 is the third sequential view showing the actual casting interiorly of the mold and wherein the reinforcing band is in its flush location;

FIG. 23 is a diagramatic showing of a pattern made from a dissolving wax; and FIG. 24 is a further view of a single airfoil patterns showing how they are oriented in a tool for gluing all of the patterns into the circular airfoil pattern.

DESCRIPTION OF THE METHOD

Figure 1:
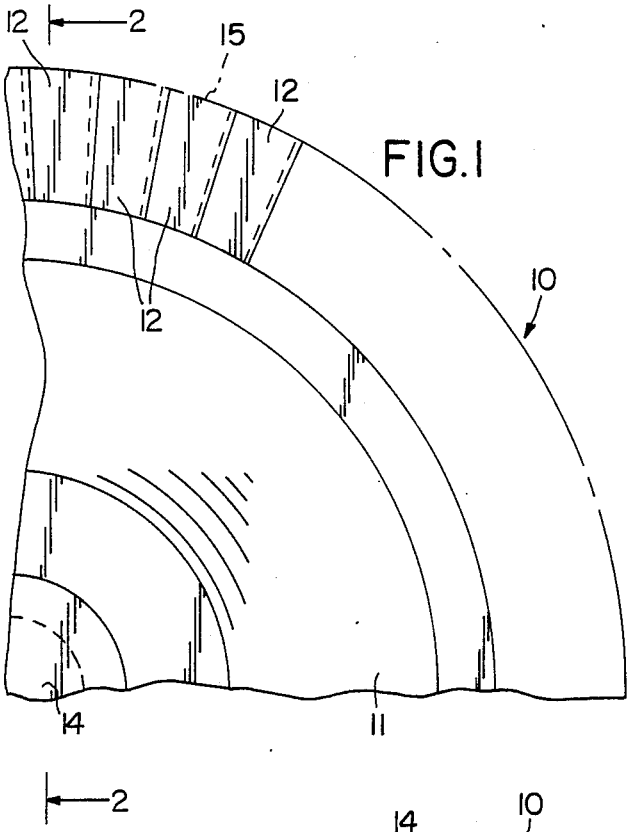
FIG. 1 is a broken view of an integral cantilevered airfoil and hub utilized in an axial flow rotor in the hot section of a jet turbine-type engine machined to remove the stabilizing band.

The method of the present invention begins with the formation of the pattern, which is to be dipped and encased in ceramic as a first step of forming the mold. Thereafter once all of the ceramic has been formed in surrounding and encapsulating relationship to the pattern, the product is then heated to a point where the pattern is destroyed and drained from the interior of the ceramic. This may be done simultaneously with the pre-heating procedure, at which time the ceramic is fired to a temperature up to approximately 2200° F. Alternatively, particularly where soluble patterns or wax assembled patterns are employed, the pattern can be removed by autoclaving at 300° to 400° F. at pressures of several atmospheres. The three different types of pattern forms are processed as indicated below.

Assembled Patterns

These patterns are made from individually assembled airfoil segments of either wax or plastic and offer the easiest and most accurate method of applying the outer band or bands. When the airfoil segments are injection molded, the band portion is desirably incorporated into the same injection cavity so that when the airfoil segments are placed into the assembly fixture for assembling the pattern, the band segments are also joined together to form the complete band. Alternatively, a separate band may be applied to the cantilevered airfoil tips to form the band portion of the casting. The object of this operation is to have a completed pattern with cantilevered air foils that have been joined by a band or band segment to bring about the stabilization of the blade tips and to provide the other benefits such as a space for inclusions to migrate and to aid fill-out.

One-Piece Wax Patterns

These patterns are usually made from mechanical inserts that can be extracted radially or as segments where it would often be otherwise impossible to incorporate the band or bands due to the back draft or undercut configuration created by the band or bands around the outside of the airfoil tips or outer circumference. Accordingly, a separate formed band or bands is applied to the cantilevered airfoil tips to accomplish the desired results.

Soluble Patterns

The band or bands are incorporated into the master pattern for the airfoil soluble wax mold and becomes part of the injected wax pattern as a result of the configuration of the soluble wax segments and the body mold. This method has the built-in disadvantages of the problems described previously in the use of soluble wax patterns.

After the pattern has been formed by any of the three above techniques, or other techniques known in the art, and the band or bands or shroud is in the pattern, the methods known in the art for forming the mold and casting are employed. This can include subsequent heat treating, sand blasting, cosmetic face grinding, and the like. At the time when the tips of the air foils are to be machined, a step which is invariably required irrespective of configuration, the stabilizing band is removed during what is termed the shaping or forming operation. In most instances the patterns are designed to provide for an extra 60 one thousandths of an inch at the end of the airfoil section to be removed and thus the band, bands, or shroud being removed at the same time utilize the same tooling and fixturing. What is important to the method is that dimensional stability of the product begins with the very formation of the pattern and carries through until the ends of the airfoil sections are machined and finally processed.

The Casting

As noted in FIG. 1, the integral casting 10 includes two principal members, a central hub 11 and a cantilevered airfoil 12. The hub has an axis of rotation 14 which is the principal point of orientation of all elements of the integral casting 10. The airfoil tips or ends 15 are the outer periphery of the unit, and normally lie in a cylindrical immaginary band. In all embodiments, the band or bands 18 join the tips or ends or other sensitive unsupported extremities 15 of the airfoil. In one instance the bands 18 are exterior of the tips or ends 15 of the airfoil 12; and in an alternative embodiment, the bands 18' are flush with the tips or ends 15 of the airfoil.

Figure 2:
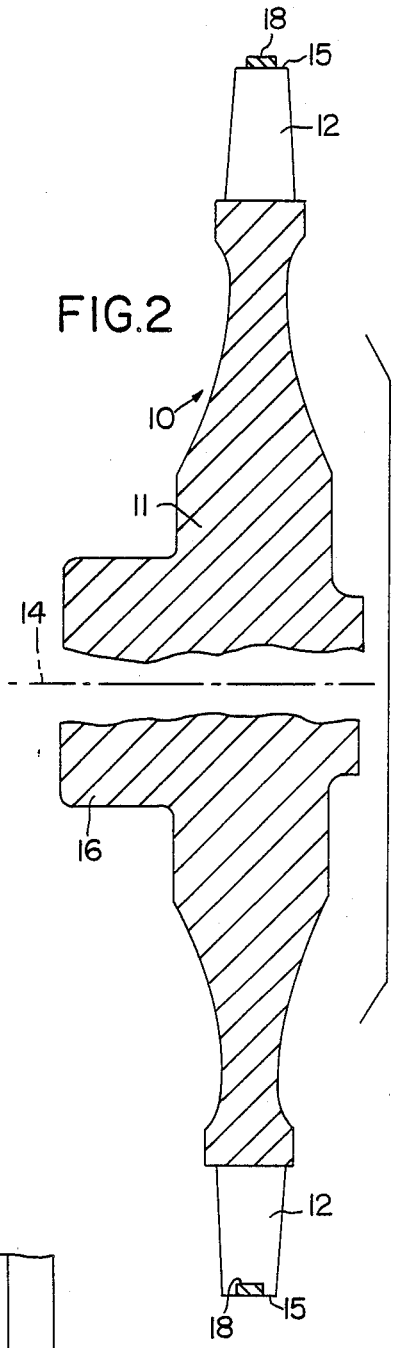
FIG. 2 is a transverse sectional view of the hub and airfoils before machining shown in FIG. 1 showing a single stabilizing band and taken along section line 2—2 of FIG. 1, the upper half of FIG. 2 showing one orientation of the reinforcing band, and the lower half of FIG. 2 showing an alternative location.
Figure 1A:
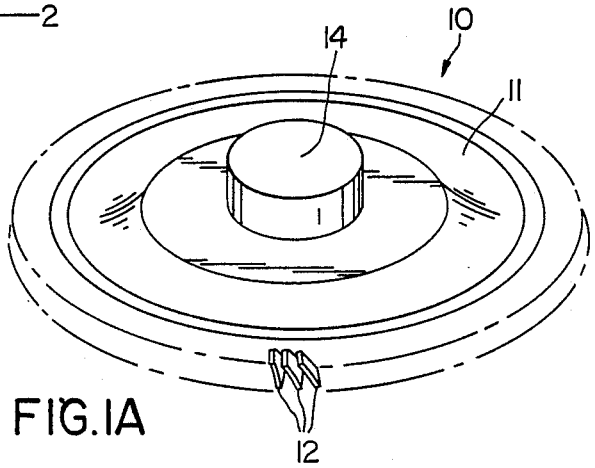
FIG. 1A is a perspective of the integral casting as shown in FIG. 1.
Figure 3:
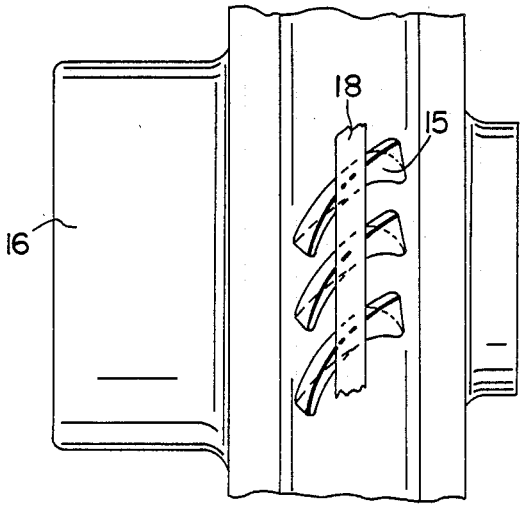
FIG. 3 is an end view primarily of the airfoil section as it extends radially from the integrally cast hub and showing a single stabilizing band.

More specifically as to FIG. 1, it shows an axial type integral casting 10 intended for use in a hot section, and having a single reinforcing stabilizing band 18 as shown in FIG. 2 and as shown in FIG. 3. In the embodiment shown in FIG. 1, the stabilizing band 18 has been removed. FIG. 1A is a perspective view of the axial type integral casting 10 as shown in FIG. 1.

Figure 4:
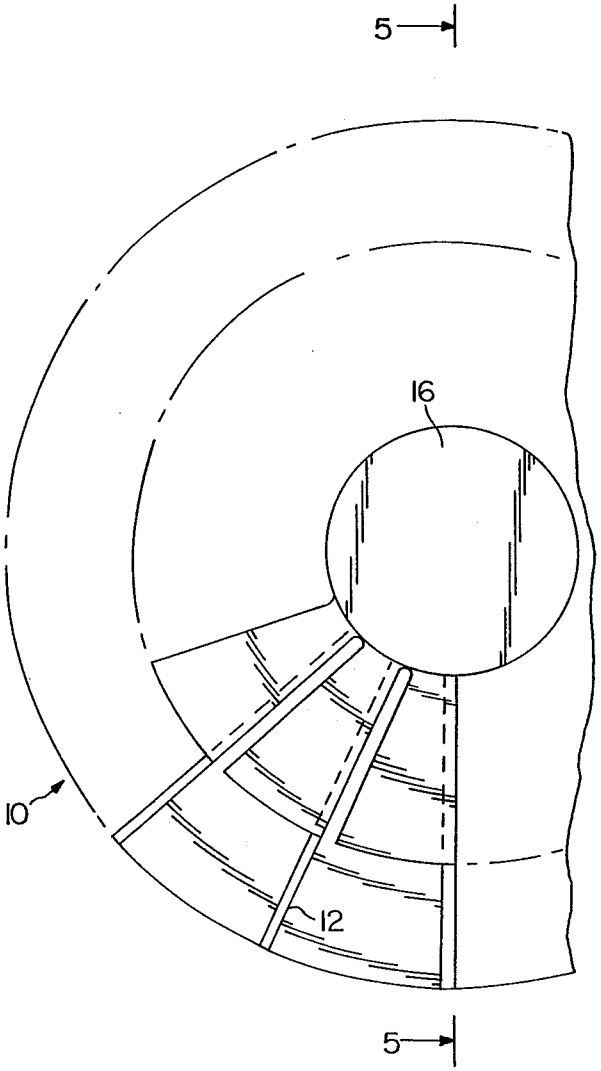
FIG. 4 is a broken front elevation of a centrifugal compressor.
Figure 6:
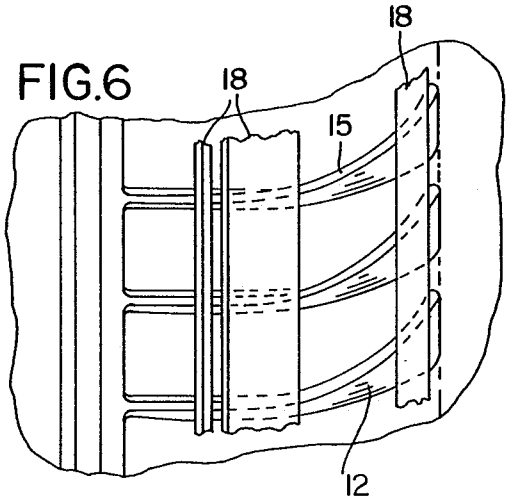
FIG. 6 shows diagrammatically the three stabilizing bands around the end portions of the airfoil sections of FIGS. 4 and 5.
Figure 5:
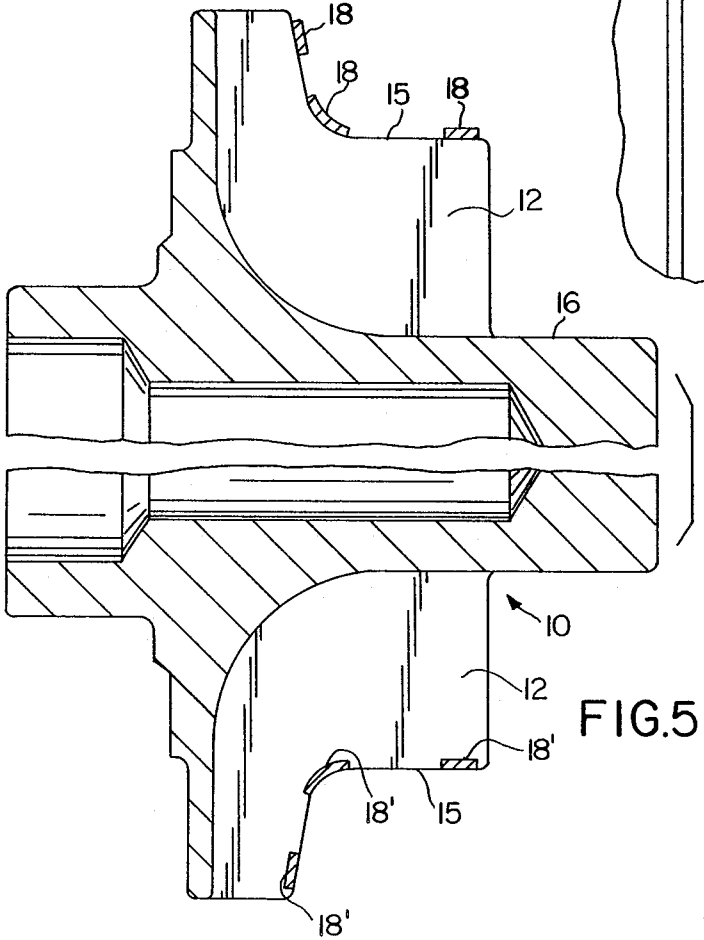
FIG. 5 shows diagrammatically in longitudinal section a three stabilizing band configuration on a centrifugal compressor, the upper portion showing one orientation of the reinforcing band, and the lower portion showing an alternative location of the reinforcing band.

Referring now to FIG. 4, it shows a typical centrifugal casting 10 for a centrifugal compressor having a plurality of cantilevered airfoils 12. FIG. 6 shows an end view of the airfoils 12 for the centrifugal construction alternative embodiment, and illustrates the stabilizing band 18 applied in three locations. On the upper portion of the casting 10 shown in FIG. 5, the reinforcing bands 18 are external to the airfoils 12. In the lower portion of FIG. 5 the alternative location of the reinforcing bands 18' in flush relationship to the ends 15 of the airfoil is shown. The three locations for the stabilizing band 18 are also shown in FIG. 5 where it will be seen that one is located at the radius, and one located at each unsupported corner of airfoil 12.

Turning now to FIG. 7, it will be seen that the typical pattern shown here is made up of pieces. The pieces begin with individual airfoil patterns 22 which include a platform 24 on the airfoil side, and a hub engaging side 25. The hub engaging side 25 is curvilinear and proportioned to engage a peripheral locating band in the hub pattern 21. The individual airfoil patterns 22 are inserted into an assembly jig, and the assembly edges 26 of the adjacent airfoil patterns 22 are joined together as shown in FIG. 8. An assembly locator 27 (see FIGS. 13–19) is provided interiorly of the airfoil pattern 22 and is masked prior to placing the pattern in the ceramic and forming the mold. To be noted particularly in FIG. 14 is the band segment 28 extending in either direction from the individual airfoil pattern 22. These are dimensioned to be within one one-thousandth of an inch of each other, and then subsequently joined, such as by gluing, in order to seal the joint. Optionally a tongue-in-groove or peg-and-hole construction 30 is provided at the ends of the band segments 30 as shown in FIG. 14. In the alternative embodiment the band 28' is flush with the end 15 of the airfoil pattern 22, as shown in FIGS. 18 and 19.

Alternatively, as shown in the upper portion of FIGS. 2 and 3, the band 18 is applied to the tips or ends of the airfoil 15 by means of a strip formed of a removable material wrapped around the pattern in an encircling fashion. This requires no modification to the mold for the airfoil pattern 22. On the other hand less dimensional stability for the pattern while it is being handled is afforded by the wrap-around wax, as compared with the case where the band segment 28 is integrally molded on the airfoil pattern 22 as shown in FIGS. 13 through 18.

The band thickness is approximately twenty to sixty one-thousandths of an inch. The band segments 28 when formed integrally are normally cast with a mold in which the matching opposed portions are pivoted at a joint spaced the same distance from the various portions of the mold as the axis of rotation of the hub of the casting. This permits withdrawal of the mold of a curved segment of the band, and also curves the hub-engaging side 25 and the platform 24 of the airfoil pattern 22. Also to be noted is that with a centrifugal turbine the band 18 can be formed around the entire periphery since the edges must all be machined to shape.

The sequence of molding is shown in FIGS. 20–22. There is will be seen that in FIG. 20 the pattern including the hub pattern 21 and the airfoil pattern 22 are cast inside of a ceramic mold 35. As shown sequentially in FIG. 21, the mold 35 is normally heated to an elevated temperature and the pattern portions 21, 22 melt or otherwise are dissolved and removed. Finally, metals introduced into the void left in the casting after removing the pattern as shown in FIG. 22, and the completed casting including the hub 11 and airfoil section 12 result. As noted specifically in FIG. 22, the stabilizing band 18' is cast integral and flush with the end portion 15 of the airfoil 12.

Optionally the patterns can be made by using soluble wax segments 38 which are held into a form, the illustrative green soluble wax 38 being shown in FIG. 23. The green soluble wax components 38 are held in position by a fixture 39, and then the gaps between the green soluble wax filled with a red wax 40. A recess is left in the exterior portion of the segments 38 which permits the red wax to form the reinforcing pattern band 18 portion of the pattern. As shown in FIG. 24, on the other hand, where the single piece airfoil patterns 22 are employed, a recess is provided at 44 to receive a pin 45 from the fixturing tool to hold the segments 22 in place in order to glue or otherwise secure the same to each other in a unitary pattern for encircling engagement with the hub pattern 21.

Shown are two alternatives of the reinforcing band 18, 18'. In the first form the band 18 is exterior to the end 15 of the airfoil 12. In the alternative, the alternative band 18' is flush with the end 15 of the airfoil 12. In all instances even in the prior art, the ends 15 of the airfoil 12 are anticipated to be machined. Extra machining stock is provided for in the integral casting 10 at the ends of the airfoil 12 which is to be machined away. By making the reinforcing band 18' flush with the end of the airfoil, it is machined away at the same time the end 15 of the airfoil is machined. The optimum thickness and orientation of the band is within the machining zone to thereby permit machining the end of the airfoil and removal of the bands in one step. The bands join the airfoil with a fillet to avoid sharp corners. Thus if the band is to be thirty thousandths thick and the fillet twenty thousandths, the machining zone is optimally fifty thousandths. An extran ten thousandths may well be provided so that variables in the fillet and band size attributable to casting will be totally removed as the ends 15 of the airfoils are machined.

The benefits of the method and integral airfoil are numerous, but they begin with dimensional stability. Dimensional stability of the cantilevered air foils are achieved to a point that mechanical straightening is eliminated or minimized. Also eliminated or minimized is the need for gaging of the individual air foils. Both of these operations are laborious, time consuming, and a heavy cost contributor to the cost of manufacturing.

The added band or bands becomes a trap or space into which metallic inclusions or ceramic inclusions can be flushed during the flow of the molten metal into the investment casting mold. This greatly improves the metallurgical soundness of the airfoil blades and reduces the possibility of failure of the casting during the operation of the turbine.

The added band or bands aid in fill-out of the thin leading or trailing edges by providing a space for the gases to be displaced into by the advancing molten metal during the casting operation. In addition, the bands provide a space for the chilled metal to continue flowing so as to minimize or eliminate surface tension of the molten metal particularly in the extreme corners of the blade tips which would normally be blind corners and accordingly, be difficult to fill out even in the case of vacuum melting and casting.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification, and the appended claims.

What is claimed is:

1. A cantilevered integral airfoil casting blank comprising, in combination, a circular support base for a plurality of airfoils, a plurality of cantilevered airfoils extending radially from the support base, each such cantilevered airfoil proportioned to have an unsupported end after casting and machining, and a stabilizing band connecting the otherwise unsupported ends in a circumferential fashion around all of the airfoils, said stabilizing band being formed with relation to the airfoils to be machined away from the airfoil after which their ends are unsupported, said stabilizing band being characterized by the random presence of unwanted metallic, ceramic, or gas inclusions not generally found in the airfoil blades.

2. In the cast blank of claim 1, said stabilizing band being formed with relation to the cast portion of the support base and airfoil to maximize the deposit of wax, air, and other impurities in an investment casting for concentration within the stabilizing band, whereby such inclusions and deposits are minimized in the airfoil and support base.

3. In the casting blank of claim 1, said stabilizing band having a width less than one-half of the width of the airfoil.

4. In the casting blank of claim 1, said stabilizing band having a thickness less than the thickness of said airfoil blades at their thickest point.

5. In the casting blank of claim 1, said stabilizing band lying in a plane substantially perpendicular with the edge of the airfoil being supported.

6. In the cast blank of claim 1, said mandatorily removable stabilizing band being oriented perpendicular to and flush with the unsupported ends of the airfoil.

7. In the casting blank of claim 6, the fillet and the thickness of said stabilizing band being proportioned to fall within the disposable stabilizing band to thereby permit machining the end of the airfoils and removal of the band in one step.

8. A dimensionally stabilized cantilevers integral airfoil intermediate casting having aa mandatorily removable integrally disposable band airfoil end-to-end comprising, in combination, a circular support base for a plurality of airfoils, a plurality of cantilevered airfoils extending radially from the support base each such cantilevered airfoil having an unsupported end after casting and machining, said disposable band being characterized by the random presence of unwanted metallic, ceramic, or gas inclusions not generally found in the cantilevered airfoils, said airfoil end being characterized by a uniformity of casting material and the absence of inclusions and contaminants attributable to a mandatorily removable reinforcing band metal which acts as an escape channel formed during casting as contrasted to a casting by casting material entering into a dead-end cavity at the unsupported end portion of each airfoil.

* * * * *